US006405463B1

(12) United States Patent
Roddy et al.

(10) Patent No.: US 6,405,463 B1
(45) Date of Patent: Jun. 18, 2002

(54) ILLUMINATED DISPLAY DEVICE

(75) Inventors: Norman Stephen Roddy, 34 Brustin Brac Road, Larne, Northern Ireland (GB), BT40 2LN; Adrian Gawain Moir, 15 Glenbrook Avenue, Belfast, Northern Ireland (GB), BT5 5JP; Robert John Hunt, 62 Limehill Road, Lisburn, Northern Ireland (GB), BT27 5LR

(73) Assignees: Norman Stephen Roddy; Adrian Gawain Moir; Robert John Hunt, all of Northern Ireland (GB)

( * ) Notice: Subject to any disclaimer, the term of this patent is extended or adjusted under 35 U.S.C. 154(b) by 0 days.

(21) Appl. No.: 09/581,925

(22) PCT Filed: Dec. 18, 1998

(86) PCT No.: PCT/IB98/02137

§ 371 (c)(1),
(2), (4) Date: Jun. 19, 2000

(87) PCT Pub. No.: WO99/31648

PCT Pub. Date: Jun. 24, 1999

(30) Foreign Application Priority Data

Dec. 18, 1997 (GB) ..... 9726696

(51) Int. Cl.[7] ..... G09F 19/00
(52) U.S. Cl. ..... 40/437; 40/476
(58) Field of Search ..... 40/429, 436, 437, 40/476, 508, 513, 509, 511

(56) References Cited

U.S. PATENT DOCUMENTS

| | | | | | |
|---|---|---|---|---|---|
| 1,888,527 | A | * | 11/1932 | Edouart | 40/650 |
| 2,943,533 | A | * | 7/1960 | Goodbar | 88/16 |
| 3,660,919 | A | * | 5/1972 | Nagel | 40/78.03 |
| 3,683,525 | A | * | 8/1972 | Fukui | 40/36 |
| 3,862,504 | A | * | 1/1975 | Ringelheim | 40/106.53 |
| 3,883,966 | A | * | 5/1975 | Ludwig | 40/36 |
| 3,918,185 | A | | 11/1975 | Hasala | 40/106.53 |
| 3,955,297 | A | * | 5/1976 | de la Chauviniere, nee Chantal et al. | 40/106.53 |
| 4,118,879 | A | | 10/1978 | Simon | 40/437 |
| 4,240,219 | A | * | 12/1980 | Tornqvist | 40/476 |
| 4,621,443 | A | | 11/1986 | Weinreich | 40/436 |
| 5,459,954 | A | * | 10/1995 | Bronaugh et al. | 40/476 |
| 5,513,458 | A | * | 5/1996 | Dehli | 40/470 |
| 5,767,650 | A | * | 6/1998 | Dehli et al. | 318/640 |
| 6,164,780 | A | * | 12/2000 | Noto et al. | 353/122 |
| 6,226,906 | B1 | * | 5/2001 | Bar Yona | 40/454 |

FOREIGN PATENT DOCUMENTS

| | | |
|---|---|---|
| WO | 9726642 | 7/1997 |

* cited by examiner

*Primary Examiner*—Robert J. Oberleitner
*Assistant Examiner*—Benjamin A. Pezzlo
(74) *Attorney, Agent, or Firm*—Baker Botts LLP

(57) ABSTRACT

An illuminated display device (10) according to the present invention comprises an image sheet (48) comprising, in turn, a plurality of series of image portions (47*a*, 47*b*, 47*c*) etc. and a mask sheet (62) having alternative opaque strips (63) and transparent windows (61). The mask sheet (62) is located in face-to-face relation to the image sheet (48). First and second roller means (64, 66) are located in a substantially parallel spaced-apart arrangement relative to the image sheet (48) and the mask sheet (62) and are operatively associated with one of the image sheet (48) and the mask sheet (62). The device (10) is provided with means to oscillatingly move the one of the image sheet (48) and the mask sheet (62) relative to the other of the image sheet (48) and the mask sheet (62). The moving means comprises a drive means (84), a cam (88); a cam follower lever (90) or (91) associated with the cam (88); and a crank mechanism comprising a crank lever (92) or (94) operatively associated with the first roller means (64) and a linkage mechanism comprising the cam follower lever (90) or (91) and the crank lever (92) or (94).

20 Claims, 7 Drawing Sheets

ILLUMINATED DISPLAY DEVICE

The present invention relates to an illuminated display device for displaying an image from a series of image portions on an image sheet. The invention has particular application for, but is not limited to, "Point of Sale" or "Commercial Poster" advertising.

There are several means of advertising by illuminated display devices or cabinets, catering for a range of poster sizes. Most of such display devices display a single advert. The advert is usually printed on paper which is secured to the front of a diffuser platen and then backlit.

There are known illuminated display devices which illuminate an image sheet, for example, an ink jet print or a photographic print, the image sheet comprising two series of image portions in strip form strategically placed behind, or in front of, a mask sheet, or grid, the mask sheet having a series of transparent windows alternating with a series of opaque strips, either the mask sheet or the image sheet being moved so that the two series of image portions on the image sheet are aligned, in turn, with the series of transparent windows on the mask sheet, thereby permitting an image formed from one of the two series of strip images, to be visible.

It will be appreciated that the clarity of each of the images, the changeover of the images and the dwell time on each of the images is of paramount importance to the advertiser. This is determined by the precision of both the assembly of the image sheet and the matching mask sheet and the drive means and tensioning means used to move the image sheet and the mask sheet relative to one another.

Previous designs, in both respects, have limited the dimensions of illuminated display devices and have been associated with significant drawbacks in terms of clarity of each of the visible images.

The present invention overcomes the limitations associated with known illuminated display devices and achieves an illuminated display device without the previous restrictions as to its dimensions and stability under varying atmospheric conditions. This enables the illuminated display device of the present invention to be used in all recognised sizes thereby vastly increasing its potential customer base.

According to the invention there is provided an illuminated display device comprising an illuminated image sheet, comprising a plurality of series of image portions; a mask sheet having alternate opaque and transparent strips, the mask sheet being located in face-to-face relation to the image sheet; first and second roller means in a substantially parallel spaced-apart arrangement relative to the image sheet and the mask sheet, the first and second roller means being operatively associated with one of the image sheet and the mask sheet; and means to oscillatingly move the one of the image sheet and the mask sheet relative to the other of the image sheet and the mask sheet, the moving means including a drive means; a cam rotatably driven by the drive means; a cam follower lever associated with the cam; and a crank mechanism comprising a crank lever operatively associated with the first roller means and a linkage mechanism connecting the cam follower lever and the crank lever.

Preferably, the image sheet comprises at least three series of image portions, preferably at least four series, most preferably five series.

The illuminated display device of the present invention is suitable for interior and exterior displays. The illuminated display device of the present invention enables a number of images to be viewed in turn. Depending on whether the illuminated display device is for interior or exterior end use, the display device may be illuminated from differing angles, for example, back-illuminated, side-illuminated or front-illuminated by, for example, sunlight or an external light source.

The visible image may comprise several separate images or, alternatively, several images creating a story line or, further alternatively, several images arranged to provide the perception of animated movement.

The display device of the present invention usually has three sections: a substantially rigid rear housing, which may contain a light source (if back-illuminated), for installation, for example, on a display stand or, more usually, on a wall; a front housing having a protective screen cover which optionally has a non-reflecting surface and which can also contain a light source (if front-illuminated); and a centre section comprising an image sheet, a mask sheet or grid having at least one series of transparent windows alternating with a series of opaque strips (opaque in this context means substantially non-transparent), the mask sheet being located in face to face relation to the image sheet; and the means to move the image sheet and the mask sheet in relation to one another. If desired, the centre section can also contain a light source for back-illumination.

Advantageously, two opposing cam follower levers and two opposing crank mechanisms are provided so that the drive means is arranged, in operative association with the first and second roller means, to impart oscillating movement to the first roller means and equal and opposite oscillating movement to the second roller means.

Preferably, the length of the first and second roller means is 10%–50% of the width of the image sheet.

More preferably, the one of the image sheet and the mask sheet which is operatively associated with the first and second roller means is tensioned by providing at least one pair of tension springs, the, or each, pair of tension springs forming a substantially V-shaped arrangement of tension lines, the apex of the substantially V-shaped arrangement being the transverse mid-line of the opposite roller means; and an opposing at least one pair of tension springs forming a substantially inverted V-shaped arrangement of tension lines, the substantially inverted V-shaped arrangement apex being the transverse mid-line of the opposite roller means.

Advantageously, the image sheet and the mask sheet are supported on a platen and the maximum height of curvature of the platen in the y-axis is between 0.3 and 2%, preferably 0.8%, of the length of the platen in the y-axis.

More advantageously, the tension springs are arranged below a notional extension of the y-axis curvature of the platen.

Even more advantageously, the platen has a maximum transverse curvature of between 3% and 20% of the maximum longitudinal curvature of the platen.

Preferably, each image portion forming one series of image portions has a pitch of 0.025–0.25%, preferably 0.05–0.21%, most preferably 0.075–0.15%, of the y-axis length of the image sheet.

More preferably, each transparent window of the mask sheet has a pitch of 30–60%, preferably about 45%, of the pitch of each image portion.

It will be appreciated that, as a consequence of the substantially parallel configuration of the first and second roller means relative to the image sheet and the mask sheet, many advantages ensue.

Specifically, the substantially parallel configuration of first and second roller means permits wide variations in the dimensions of the image sheet and the mask sheet, for example, within the range of A4, A3, A2, A1, A0 to six sheet dimensions. Table 1 shows the x-axis (transverse) and y-axis (longitudinal) dimensions of such sheets, although it will be appreciated that, when used in landscape format, the x-axis and y-axis dimensions are transposed. Equally, the illuminated display device of the present invention can be used to display intermediate sizes or larger sizes, depending on the desired end application. In addition, the illuminated display device of the invention can accommodate additional combination dimensions, for example, A0 wide (840 mm) and A4 high (235 mm).

TABLE 1

| Sheet Identity | Transverse (mm) | Longitudinal (mm) |
|---|---|---|
| A4 | 165 | 235 |
| A3 | 235 | 330 |
| A2 | 420 | 595 |
| A1 | 595 | 840 |
| A0 | 840 | 1190 |
| 6 sheet | 1200 | 1800 |

Provision of third and fourth roller means (not shown) at right angles to the first and second roller means, with a second drive means (not shown) operatively associated with the third roller means and, preferably, with the fourth roller means, permits the display of a series of images in either portrait or landscape configuration, as desired.

It will be appreciated that the one of the mask sheet and the image sheet which is oscillatingly moved under the influence of the moving means, is, in effect, an integral part of the moving means. This integral role results in improved clarity of the displayed image.

Furthermore, the dimensional flexibility of the image sheet and the mask sheet opens the way for further opportunities in the arrangement of images on the image sheet—previously only two or three series of image portions in strip form have usually been used on a single image sheet.

Due to the improved moving means of the present invention, up to five full series of non-animated image portions in strip form can be incorporated on an image sheet for use in an illuminated display device of the invention. Equally, up to ten full series of animated image portions in strip form can be incorporated on an image sheet. In addition, the image sheet can incorporate various series of image portions arranged in a grid configuration, so that several images are on display at the same time. Thus, up to five sequential images can be displayed in a grid configuration, each composed of several individual images.

Embodiments of the invention will now be described, by way of example, with reference to the accompanying drawings, in which.

In the drawings, similar numerals have been used to indicate like parts.

Figure 1:
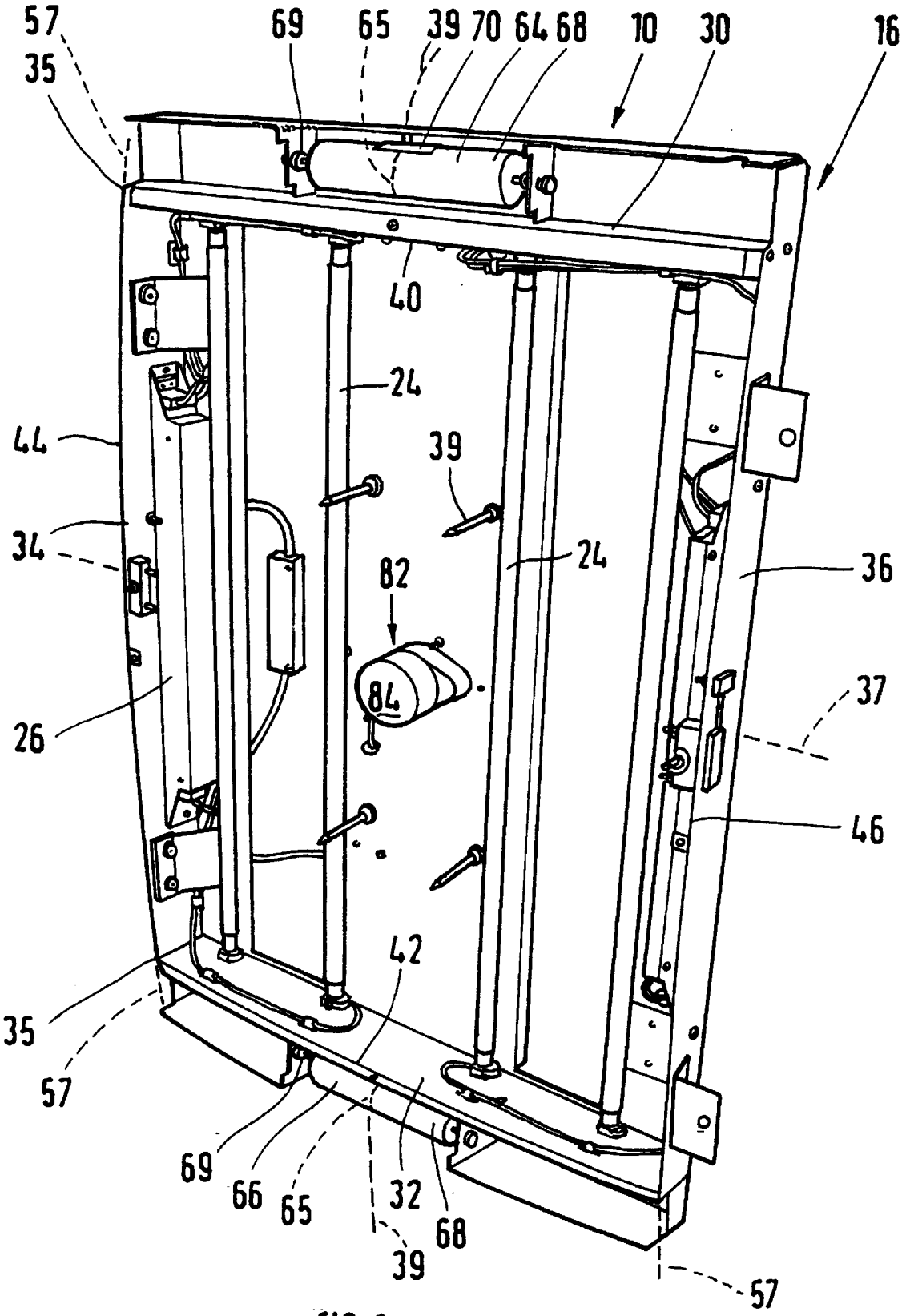
FIG. 1 is a perspective front view of an illuminated display device according to the invention, in which an image sheet and a mask sheet have been omitted for clarity and in which a platen is transparent.
Figure 2:
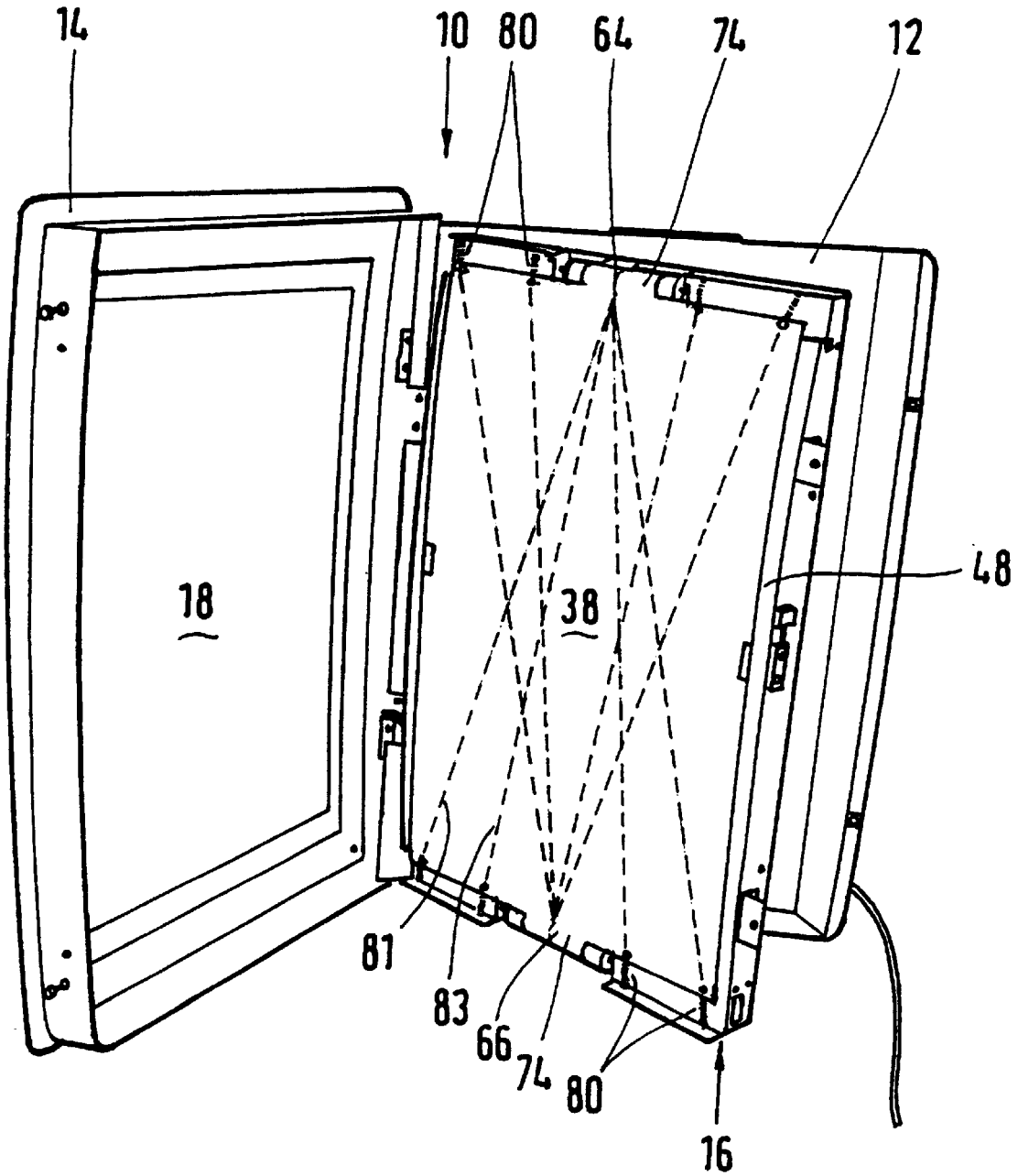
FIG. 2 is a perspective front view of a tensioning means of the illuminated display device of FIG. 1.
Figure 3:
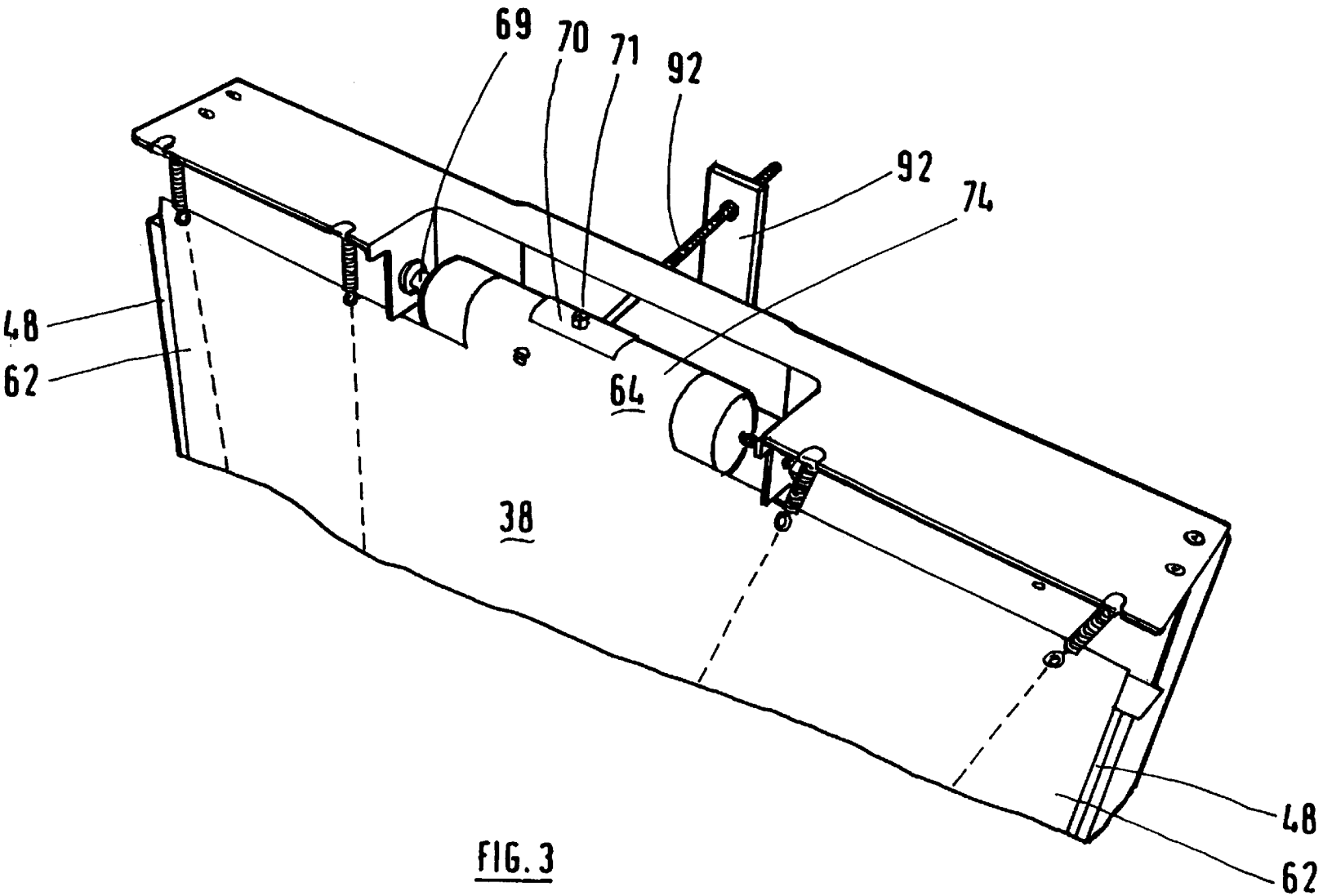
FIG. 3 is an enlarged perspective partial view of the tensioning means of FIG. 2.

Referring now to FIGS. 1–5 and 7 of the accompanying drawings, there is illustrated an illuminated display device according to the invention, generally indicated as 10.

The illuminated display device 10 of the invention comprises a rear housing 12, a front housing 14, and a support means 16. The front housing 14 includes an opening 18 to permit the displayed image to be viewed therethrough.

In the illustrated embodiment, the support means 16 is provided with an illumination means comprising one or more light tubes 24. The light tubes 24 may be provided with an electronic ballast ignition means 26 although it will be appreciated that any ignition means will be suitable for incorporation in the illuminated display device 10 of the present invention. The ignition means 26 is connected to a power supply (not shown) by a power cable (not shown).

The support means 16 also includes first and second oppositely disposed side walls 30, 32, which extend at right angles between third and fourth oppositely disposed side walls 34, 36. The outer margins of the first and second side walls 30, 32 are substantially rectilinear and the outer margins of the third and fourth side walls 34, 36 each form a substantially arcuate outwardly convex surface, hereinafter referred to as a curved support means, to support and shape a platen 38. The first and second side walls 30, 32 are at the same height as the lower edges 35 of the curved support means formed by each of the third and fourth side walls 34, 36. The height difference between the lower edges 35 and transverse platen mid-line 37 is hereinafter referred to as the maximum y-axis curvature height.

The platen 38 has first and second substantially parallel rims 40', 42' extending from first and second substantially parallel margins 40, 42, the margins 40, 42 being at right angles to third and fourth substantially parallel margins 44,46; and an arcuate outwardly convex surface which curves outwardly from the margins 40, 42 partly because the platen 38 is supported on the curved support means. The first and second rims 40', 42' are attached by screws or the like fixing means to the first and second side walls 30, 32, respectively, of the support means 16. The platen 38 is usually opaque and, as such, may be formed from a plastics, for example, Perspex of Lexan (Trade Mark) or a glass type material. Alternatively, the platen 38 may be substantially transparent and, in that event, the diffuser effect is created by the printing method chosen for an image sheet 48. Specifically, the series of strip images may be photographed onto a diffuser support material.

The y-axis (longitudinal) curvature of the curved support means, and consequently of the platen 38, is chosen at minimum radius to reduce friction between the image sheet 48 and the mask sheet 62, to maintain the desired overall touching contact between the image sheet 48 and the mask sheet 62, and to achieve optimum clarity of displayed image. Empirical experiments have indicated that the maximum y-axis curvature height of the curvature of the platen 38 relative to margins 40, 42 should be between 0.3% and 2%, preferably 0.5 to 1.0%, most preferably about 0.8%, of the length of the platen 38 in the y-axis. Thus, the maximum y-axis curvature height of the platen 38 (at the platen transverse mid-line 38), and should, most preferably, be about 4.75 mm for an A2 size portrait platen 38 and about 6.75 mm, 9.5 mm and 14.4 mm for an A1, A0 and six sheet size portrait platen 38, respectively.

The curve of the arcuate convex surface of the platen 38 is selected to provide sufficient tension between the image sheet 48 and a mask sheet 62, so as to display the image without distortion but with minimal friction between the image sheet 48 and the mask sheet 62. The radius of the curve can, for example, be up to 1 m on display devices for interior applications, and up to 4 m on display devices for larger interior, and exterior applications. The arcuate convex surface of the platen 38 should be a constant curve so that constant contact between the image sheet 48 and the mask sheet 62 is maintained. For larger display devices, it is necessary to support the platen 38 on pin struts 39 (see FIG. 1) of the desired height, so as to maintain the desired constant y-axis (longitudinal) curve across the platen 38, which constant longitudinal curve is generated, at lateral margins 44, 46, by the shape of the curved support means and, thereby, prevent the occurrence of indentations on the platen 38.

The curvature of the platen 38 and the desired touching contact between the image sheet 48 and the mask sheet 62 is further enhanced by imparting a small transverse curvature (in the x-axis) between the curved support means at each lateral margin 44, 46 of the unit 10. This is achieved by supporting the platen 38 on strategically positioned pin struts 39 of a height to support and maintain a desired transverse curvature. The desired maximum transverse curvature (in the x-axis) should be a further between 3% and 20% of the maximum longitudinal curvature (y-axis). For example, if the maximum height of the longitudinal curvature is raised by 10 mm, then the maximum transverse curvature height should be further raised by between 0.3 and 2.0 mm and thus, at an intersection of the transverse and longitudinal platen mid-lines 37, 39, the platen 38 is between 10.3 and 12 mm higher than the height of the lower edges 35. It will be appreciated that the pin struts 39 should, desirably, be translucent with as small as is possible a diameter so as not to restrict illumination or cause dark marks or reflections on the illuminated image.

Figure 7:
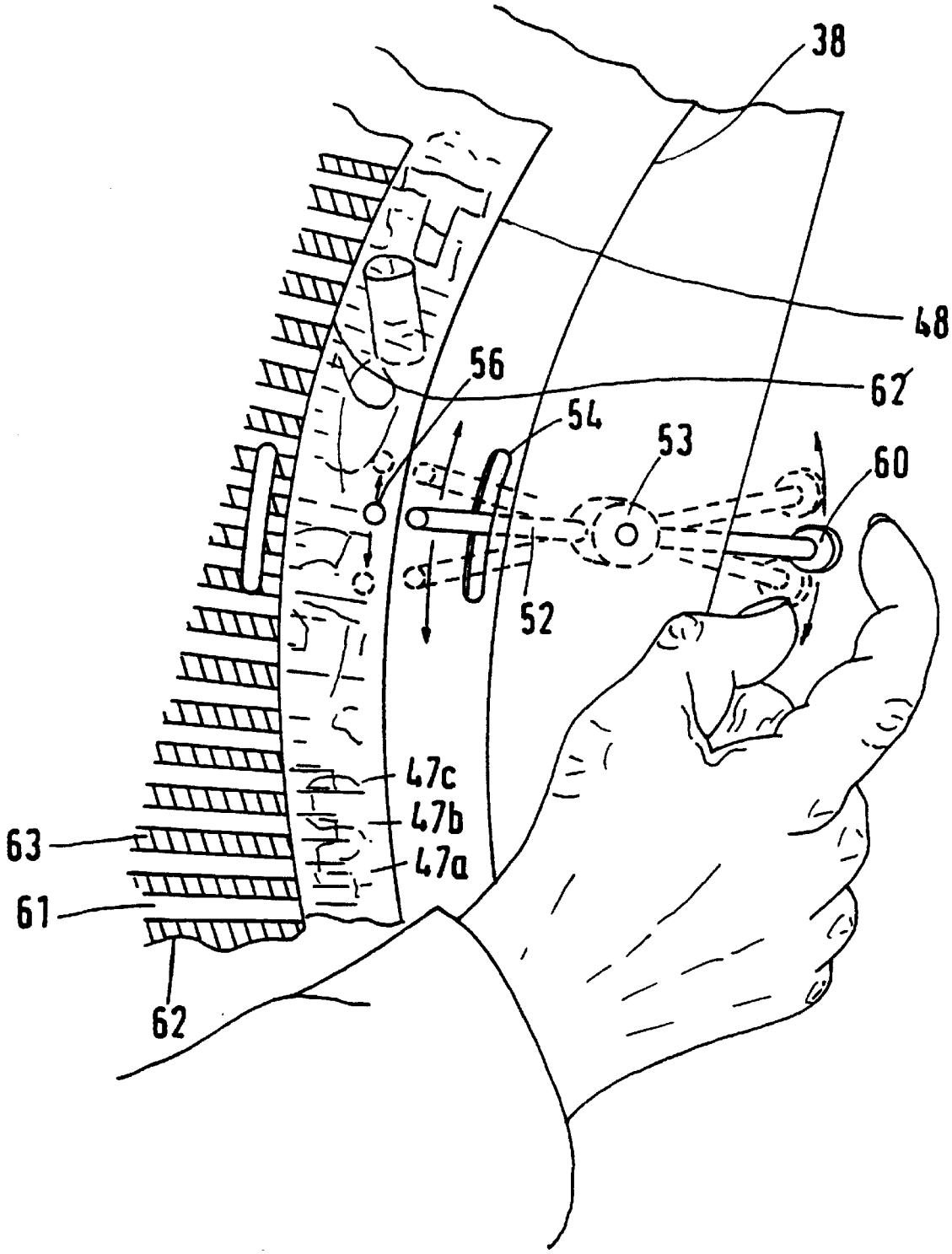
FIG. 7 is an enlarged perspective partial view of a fixing means for use in the illuminated display device of FIGS. 1–4.

An image sheet 48 is located, in use, on the platen 38 and is fixed in position on the platen 38 by a fixing means, generally indicated as 50 (see FIG. 7). The fixing means 50 comprises a pair of forwardly disposed image locating pins 52, one adjacent each lateral margin 44, 46 of the platen 38, each of which is pivotably mounted at 53 on the respective side walls 34,36 forming the platen curved support means. Each pin 52 extends through a slot 54 provided in the platen 38 and through a push-fit sized aperture 56 provided in the image sheet 48.

A slot 58 is provided in the rear housing 12 (see FIG. 7), through which protrudes a screw-threaded pin/nut/friction washer arrangement 60. In use, the image sheet 48 can be moved relative to the first and second margins 40, 42 of the platen 38 by pivotably urging the, or each, image locating pin in the desired direction and by subsequently tightening the or each nut/friction washer against the rear housing 12, when one series of strip portions on the image sheet 48 has been aligned, in the x-axis, with a series of transparent windows 61 on the mask sheet 62.

A mask sheet 62 is located, in use, on top of the image sheet 48/platen 38. First and second roller means generally indicated as 64, 66, respectively, are arranged in a substantially parallel, spaced-apart configuration, with the main axes (longitudinal axes) of the first and second roller means 64, 66 substantially parallel with the respective first and second side walls 30, 32 of the support means 16. Each roller means 64, 66 includes a respective short drive shaft 68 which is rotatably mounted on the support means 16 using a pair of rotation bearings (see FIG. 3). Each drive shaft 68 is rotatably supported between the pair of rotation bearings 69. Each pair of rotation bearings 69 is adjustable, back and forth, in the longitudinal direction of the roller means 64, 66. This has been found necessary to ensure optimal tensioning of the mask sheet 62 since the longitudinal mid-line 39 of the mask sheet 62 must be secured to the exact middle (transverse mid-line) 65 of each roller means 64, 66, to avoid distortion of the mask sheet 62.

The mask sheet 62 is provided with extensions 74, 74' for reversible engagement of the mask sheet 62 between respective substantially C-shaped members 70 (sleeves) and the drive shafts 68 of the first and second roller means 64, 66.

It is desired that the top circumference of the first and second roller means 64, 66 be positioned at, but not above, a notional extension 57 to the y-axis curvature of the platen 38. The top circumference of the first and second roller means 64, 66 may be up to 2 mm lower than the notional extension to the y-axis curvature of the platen 38. Thus, the smallest distance between the first or second roller means 64, 66 and the notional extension 57 is 0–2 mm.

The mask sheet 62 is secured to the roller means 64, 66 by means of the substantially C-shaped sleeve 70 and a screw 71 arrangement which securely clamps the longitudinal mid-line 39 of the extensions 74, 74' of the mask sheet 62 to the transverse mid-line 65 of the first and second roller means 64, 66. This imparts oscillating movement to the mask sheet 62 without any angular distortion of the mask sheet 62. The mask sheet 62 therefore becomes an integral part of a moving means 82.

Tensioning means, generally indicated as 78, in the form of a plurality of equal and opposing tension springs 80, maintain the mask sheet 62 in touching contact with the image sheet 48. The tension springs 80 are located to hold the mask sheet 62 above, and in touching contact with, the image sheet 48, without distortion of the mask sheet 62. For an A2 size device, the tension springs 80 are arranged in two opposed pairs, so that tension is conveyed across the mask sheet 62 to the transverse mid-line 65 of the opposite roller means, as diagrammatically indicated by tension lines 81 on FIG. 2. Thus, each tension spring 80 of a pair tensions the mask sheet 62 between respective adjacent laterally opposed edges of the mask sheet 62 and the screw 71 at the transverse mid-line 65 of the longitudinally opposite sleeve 70 thus forming a substantially V-shaped arrangement of tension lines 81.

The one pair is opposed by a second pair of tension springs, forming a substantially inverted V-shaped arrangement of equal and opposing tension lines 81. However, for an A0 size device (see FIGS. 2 and 3), four pairs of regularly spaced opposed tension springs are required (forming two substantially V-shaped arrangements of tension lines 81 and two substantially inverted V-shaped arrangements of tension lines 81), whilst, for a six sheet size device (not shown), six pairs of regularly spaced opposed tension springs are required. Each tension spring 80 must, in any event, exert tension along a notional tension line 83 between its point of engagement with the mask sheet 62 and the transverse mid-point 65 of the opposite sleeve 70. In addition, the action of each tension spring 80 must be balanced by an opposing tension spring 80. Thus, the positioning of the tension springs 80 must be symmetrical about both the longitudinal mid-line 39 of the platen 38 and the transverse mid-line 37 of the platen 38.

When the roller means 64, 66 oscillate the mask sheet 62, the springs 80 compensate for (or dampen) the oscillating movement, while retaining tension and overall contact with the image sheet 48. The tension springs 80 are positioned to pull at or below a notional extension 57 extending from the y-axis curvature of the platen 38. The top circumference of the tension springs 80 may be positioned at or just below (but not above) the notional extension 57. Thus, the smallest distance between the tension springs 80 and the notional extension 57 is 0–2 mm. As the mask sheet 62 oscillates, in the y-axis , each series of image portions is displayed for a predetermined time and then fades away as the next series of image portions becomes visible.

Alternative means of locating, securing and tensioning the mask sheet 62 have been tried without success. For example, the second roller means 64, 66 could be increased in length to equal the overall width of the platen 38. In that event, the mask sheet 62 could be directly clamped to such long roller means or could be indirectly connected to the such longer roller means by regularly spaced springs, for example, on an A0 size device, at five equally spaced points. There are two main disadvantages with such systems.

Highly accurate tensioning of the mask sheet 62 to the drive rollers 64, 66 is necessary to achieve correct tension of the mask sheet 62 so as to avoid distortion whilst maintaining touching contact with the image sheet 48 across the length and breadth of the mask sheet 62. Additionally with such a system a small twist in the display unit, during for example installation on a wall, can put the longer drive rollers out of exact parallel configuration with the platen 38 and result in loss of touching contact between the image sheet 48 and the mask sheet 62 with a resultant loss of image clarity.

The present method of tensioning the mask sheet overcomes these disadvantages by facilitating a lower accuracy level which tolerates installation accidents and the like.

Empirical experiments have found that a first and second roller means 64, 66 having a length of 175 mm, may be used for A2 up to six sheet portrait size devices 10. Thus the first and second roller means 64, 66 may be 10–50%, preferably 20–45%, of the width of the platen 38.

To change the image sheet 48, the image sheet 48 is disengaged from the pins 52 and the image sheet 48 is withdrawn by sliding it laterally in parallel to the rollers 64, 66 from below the mask sheet 62.

Figure 4:
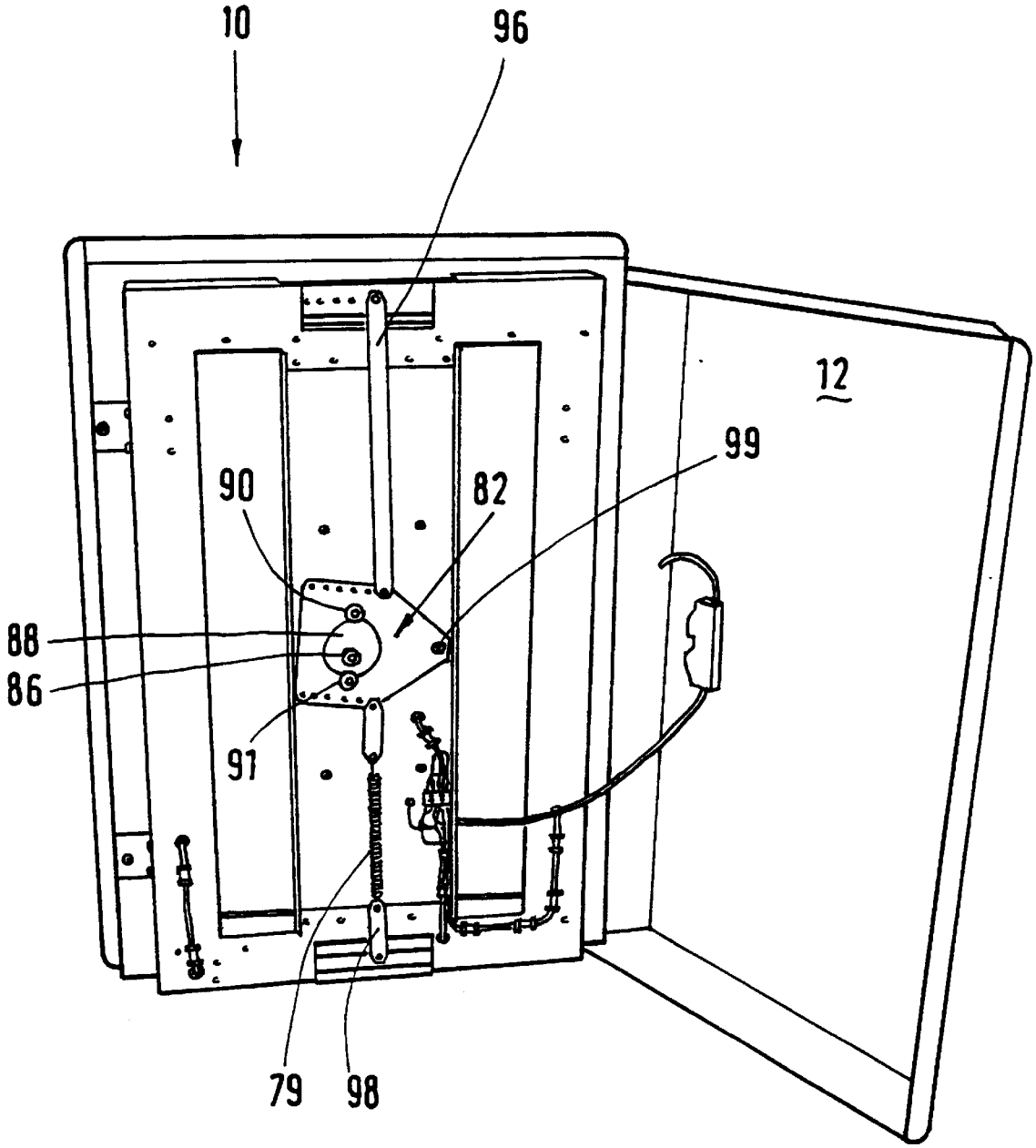
FIG. 4 is a rear perspective view of the illuminated display device of FIG. 1.
Figure 5:
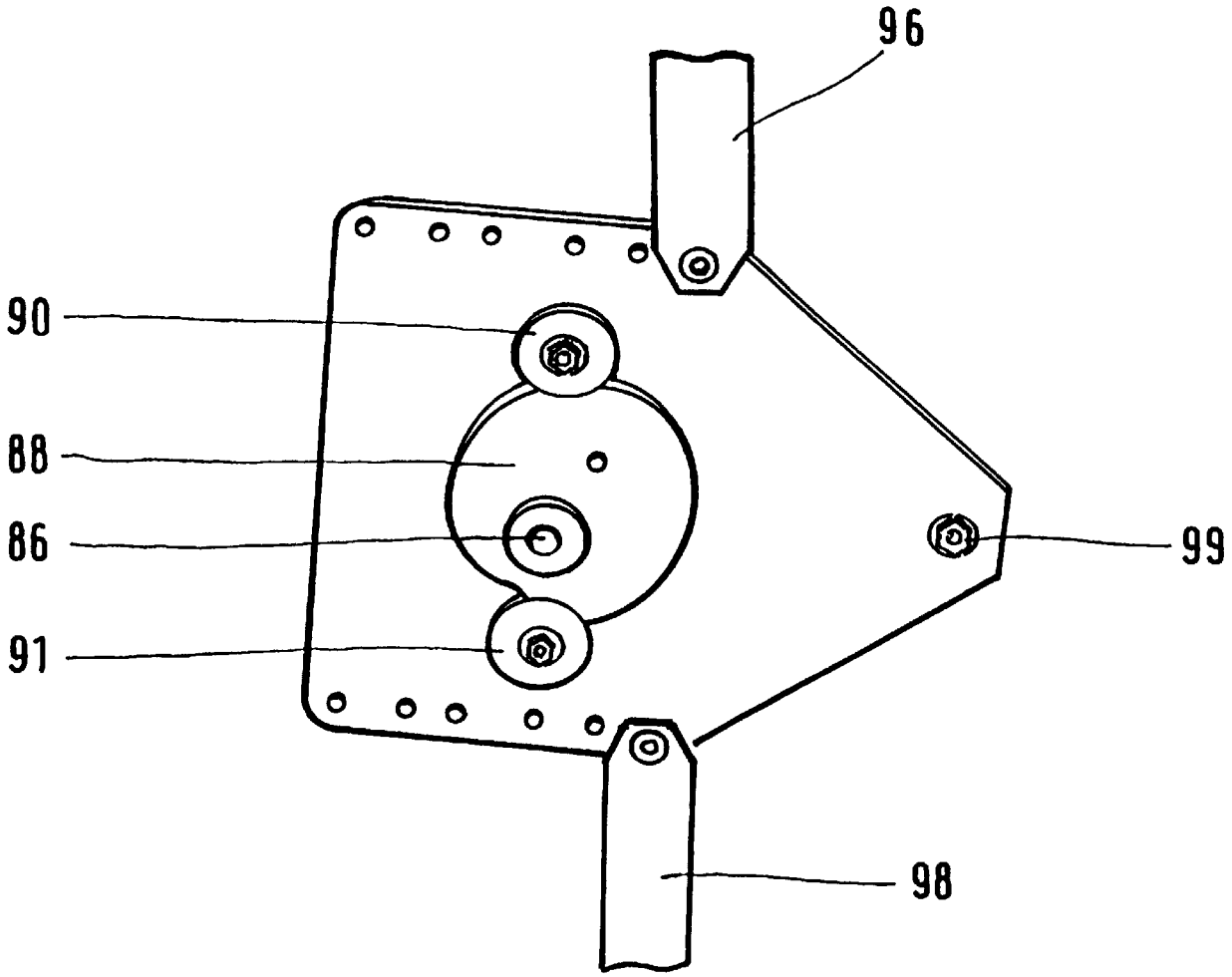
FIG. 5 is an enlarged view of a cam and opposed cam follower levers of the illuminated display device of FIG. 4.
Figure 6:
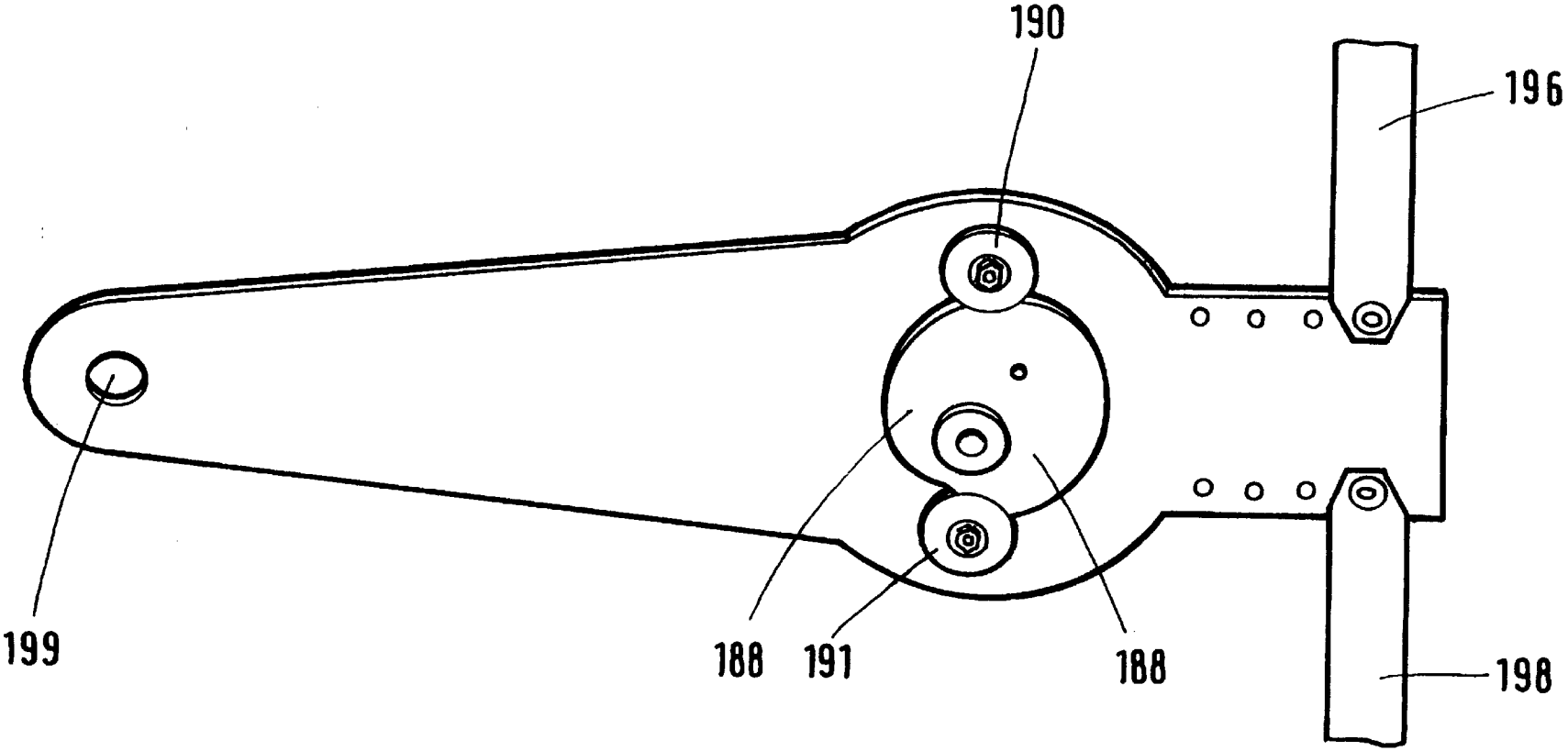
FIG. 6 is an enlarged view of an alternative cam and opposed cam follower levers for use in the illuminated display device of FIGS. 1–4.

With particular reference to FIGS. 4–6 of the accompanying drawings, the illuminated display device 10 of the present invention includes a moving means generally indicated as 82. The moving means 82 includes a drive means or motor 84 having a drive shaft 86 extending therefrom. A cam 88 (for non-animated use, usually a fixed velocity or constant rise, constant fall) is mounted on the drive shaft 86. Two opposing cam follower levers 90, 91 are provided to convert the rotary movement of the drive shaft 86 into fixed velocity oscillating movement of the cam follower levers 90, 91. It will be appreciated that the opposed dispositions of the cam follower levers 90, 91 ensures that the oscillating movement of the cam follower lever 90 is equal and opposite to that of the cam follower lever 91.

In the preferred embodiment of the display device 10 of the invention (non-animated use), the lever mechanism carrying the cam follower levers is adjusted in leverage length relative to the spacing of the image portions in strip form on the image sheet 48, to expose a pre-determined number of images in both the upward travel and downward travel of the mask sheet 62, thereby varying the number of images displayed in each revolution of the cam 88. The RPM of the drive motor 84 can be varied to increase or decrease the time cycle of the image changes and such change will also result in longer or shorter dwell time on each image during the cycle.

The cam 88 dimension and the short roller 64, 66 dimensions, however, could also be varied to achieve similar results.

The cam 88 may be a fixed velocity cam or a constant rise and quick return cam depending on story line or animation image exposure.

The display, therefore, can be a variable time image effect, a static display or a display in animation mode.

Assuming a cam lift of 20 mm, an overall distance of 127.5 mm between a pivot point 99 and the linkage mechanism 96 (B) and a distance of 85 mm between the pivot point 99 and the cam follower lever (A), the maximum oscillatory movement is 30 mm. This is calculated by:

$$\text{Cam lift} \times \frac{B}{A} = C$$

Thus, the incorporation of a cam follower lever confers a 50% mechanical advantage in observed oscillatory movement over the actual cam 88 lift. The actual mechanical advantage observed will depend on the B:A ratio and can be varied as desired.

Assuming a drive roller radius of 15 mm (E) and a lever length of 50 mm (D), the maximum oscillatory movement conveyed to the one of the mask sheet or image sheet being moved is 9 mm. This is calculated as follows:

$$\frac{C \times E}{D} = F$$

Thus, assuming an image pitch (width) of 1.5 mm, six sequential series of strip images would be visible per cam lift and, therefore, twelve series of strip images are visible, in turn, per revolution of the constant rise/constant fall cam 88.

When it is desired to provide twelve series of strip images to be viewed, in turn, per revolution of the cam 88, this can conveniently be achieved in the following manner, whilst maintaining distances A, D and E constant at, respectively, 85 mm, 50 mm and 15 mm and a constant cam lift of 20 mm.

| Device Size | Image Pitch (mm) | B (mm) | C (mm) | F (mm) |
|---|---|---|---|---|
| A2 | 0.7 | 59.5 | 14 | 4.2 |
| A1 | 0.85 | 72.25 | 17 | 5.1 |
| A0 | 1.0 | 85 | 20 | 6.0 |
| Six Sheet | 1.5 | 127.5 | 30 | 9.0 |

Thus, in a preferred embodiment, the cam follower levers 90, 91 are provided with a series of holes whose respective distances (B) and (C) from the pivot point 99 fulfil the above-mentioned guidelines for the size of unit involved.

If the motor is a 0.625 rpm motor (⅝th), one complete rotation of the cam 88 will take 96 seconds and, if there are to be twelve pictures per complete revolutions, the picture will change every eight seconds.

It will be appreciated that the same number of pictures per minute could be achieved by altering the cam lift dimension and/or the roller radius (E) and/or the cam follower lever dimension (A) and/or the lever dimension (D). Equally, the number of pictures per complete revolution can be varied by altering any of these factors.

The cam 88 is designed to be easily detached from the drive shaft 86, thereby permitting alteration of the cam lift dimension, which in turn alters the oscillatory travel of the mask sheet 62 within one revolution of the drive shaft 86 and consequentially alters the number of image changes within the given time of one drive shaft 86 revolution.

For example, a constant velocity 88 cam may be replaced with a cam having a constant velocity lift side and a quick return side. Such a cam 88 is used for exposing images on the image sheet in animation whereby, when the cam follower levers 90, 91 are in contact with the cam 88 on the lift side, images so placed on the image sheet will be exposed, by the movement of the mask sheet 62, in animation and, as the cam follower levers 90, 91 are in contact with the cam 88 on the quick return side, the mask sheet 62 is quickly returned to the start position to re-start the animation sequence. In such an animated embodiment, the number of different image strips will equal the number of images displaced by the lift side of the cam 88.

It will also be appreciated that the illuminated display device 10 may be provided with a single cam follower lever/linkage mechanism connected to a single drive shaft and, in that event, the other shaft operates as a driven shaft (not shown). Such an arrangement is more suitable for smaller, for example, A3 size, display devices. Any other method of effecting oscillating movement of the, or each, shaft is also contemplated by the present invention.

Adjustable first and second crank levers in the form of screws 92, 94 extend diametrically through screw-threaded apertures provided in the respective first and second roller means 64, 66. The free end of each crank lever 92, 94 is connected by a respective linkage mechanism 96, 98 to a respective cam follower lever 91, 90.

It will be appreciated that such adjustable crank levers 92, 94 permit adjustment of the distance between the mid point 65 of the first and second roller shafts 64, 66 and the point of connection to the respective linkage mechanisms 96, 98, whilst the radius of each roller shaft 64, 66 remains constant—thus, a mechanical advantage is gained. The mechanical advantage adds to the smoothness of movement of the mask sheet 62.

The mechanical advantage is adjustable by moving each linkage mechanism 96, 98 towards, or away from, the centre point 65 of the respective roller shafts 64, 66. This adjustment alters the length of movement of the mask sheet 62 and ensures a clear image at the top and bottom (change over points) of the rotating cam 88. An additional spring 79 is interposed within one of the linkage mechanisms 96, 98 to impart the appropriate tension to the mask sheet 62. The tension of the spring 79 is selected to provide the correct level of tension, and contact with the image sheet 48 without undue friction being applied between the image sheet 48 and the mask sheet 62, whilst also having sufficient tension so as to move the mask sheet 62 through the linkage mechanisms 96, 98 as though it were a solid coupling.

Alternative means of oscillating the roller means 64, 66 (short drive shafts) have been tried but were unsuccessful in the clarity of image displayed. For example, the short drive shafts could be driven individually by geared motors equipped to alternately reverse direction to provide an oscillating movement. Alternatively, the short drive shafts could be interconnected by chain or belt drive and driven by one geared motor suitably equipped to give oscillating movement. The disadvantage of such drive systems is the loss of mechanical advantage, picture clarity adjustment at the reverse (change over) points and the depth dimension of the display device necessary to contain such mechanisms.

The motor 84 may be, for example, a micro gear motor with a rotational speed selected for the desired image display time. The distance of movement of the mask sheet 62 is controlled by the pitch dimension (cam lift) of the cam 88 and the mechanical advantage of the first and second crank levers 92, 94. This mechanical advantage also reduces torque and noise output of the motor 84.

The degree of oscillation of the mask sheet 62 is controlled by the crank levers 92, 94 in the following manner. As the distance between the free end of each crank lever 92, 94 and the respective longitudinal pivot axis of the first and second roller means 64, 66 is reduced, by partially unscrewing the respective crank lever 92, 94 relative to its roller means 64, 66, the crank lever's mechanical advantage or leverage distance ("throw") is reduced, which in turn reduces the degree of oscillation of the mask sheet 62.

The illuminated display device 10 of the present invention is used in the following manner. The desired image sheet 48 is located on the platen 38 using the fixing means 50. The mask sheet 62 is then located over the image sheet 48, with its extensions 74, 74' reversibly connected between the respective sleeves 70 and opposing roller means 64, 66. The tensioning means 78 is then engaged. The mask sheet 62 is aligned with the image sheet 48 in the following manner. The image sheet 48 is moved, after releasing the pin/nut/friction washer 60, so as to align one series of image portions through the transparent strips 61 of the mask sheet 62. When the transparency sheet 48 is so aligned, the fixing means 50 are then tightened in place.

The front housing 14 is then fixed to the rear housing 12. When the moving means 82 of the illuminated display device 10 is actuated, the controlled oscillating movement of the drive shaft 68, under the influence of the moving means 82, in association with the tensioning means 78, permits sequential display of a series of images from the image sheet 48.

The relationship between the multiple images on the image sheet 48 and the transparent windows 61 on the mask sheet 62 are designed to accomplish several important features in the illuminated advertising display unit 10 of the present invention. The multiple images, assembled as image portions in strip form on the image sheet 48, are varied, in strip form width, depending on the display unit dimensions. The width of each image strip 48 and the relationship with the transparent window 61 width on the mask sheet 62 is vital to ensuring a satisfactory optical quality and the desired visual display.

The relationship also permits a consistent optical quality when applied throughout the range of display unit sizes. Moving outside the boundaries described herein will make the unit unacceptable in optical performance. The image strip width has been formulated to comply with the various display unit dimensions. This allows previous printing problems associated with scaling up to larger display units to be overcome and, coupled with new printing techniques and materials used to create the image sheet 48 and the accompanying mask sheet 62, provides the accuracy needed to provide the optical clarity required across the length and breadth of each of the display units.

The control of stability of the image sheet 48 and the mask sheet 62 under differing atmospheric conditions, for example, temperature and moisture, is a further problem encountered on known display devices. It has been found that, where the image sheet 48 and mask sheet 62 are manufactured by different printing techniques, the materials, or films, for both image sheet 48 and mask sheet 62 should have similar expansion or contraction properties under differing conditions. Preferably, the materials of the respective image sheet 48 and the mask sheet 62 should have minimal, most preferably no, expansion or contraction properties under the usually encountered atmospheric conditions.

The accuracy of printing the multiplicity of image portions in strip form, and the co-operating transparent windows 61 on the mask sheet 62 must be maintained over the overall length, to project a consistent optical display over the entire surface of the display unit 10 as the mask sheet 62 oscillates, thereby revealing image by image by image in turn.

Suitable printing techniques include, for example, ink jet, flat bed, laser or photographic imaging.

Limitations in printing technology have hitherto been the principle limiting factors in previous designs whereas, under the present invention, for example, an image strip width could be 0.5 mm on an A3 size and up to 2.4 mm on a six sheet size display unit. Table 1 shows the preferred dimensions and limiting dimensions.

TABLE 1

| Unit | Strip Image Width (mm) | | | Transparent Window Width (% of preferred strip image width) | | |
|---|---|---|---|---|---|---|
| Size | Minimum | Maximum | Preferred | Minimum | Maximum | Preferred |
| A2 | 0.4 | 1.2 | 0.8 | 30 | 60 | 45 |
| A1 | 0.5 | 1.5 | 1.0 | 30 | 60 | 45 |
| A0 | 0.6 | 1.8 | 1.2 | 30 | 60 | 45 |
| 6 sheet | 0.8 | 2.4 | 1.6 | 30 | 60 | 45 |

Thus, the preferred transparent window widths 61 for a mask sheet 62 for use of an A2, A1, A0 or six sheet unit size would be 0.36 mm, 0.45 mm, 0.54 mm or 0.72 mm, respectively.

The mask sheet 62 has an arrangement of transparent windows 61 and opaque strips 63 (see FIG. 7). The transparent windows 61 display one image at a time while the opaque strips 63 obscure the other series of image portions in strip form on the image sheet 48.

A feature of the invention is the relationship between the image strip width and the width of the transparent window 61 on the mask sheet 62.

Assuming that an image sheet 48 contains three series of strip images, each of a preferred 0.8 mm width (A2 unit size), and assuming that the mask sheet 62 has a preferred transparent window 61 of a preferred 0.36 mm width (45% of strip width), this means that each opaque strip 63 has a width of 3×0.8 mm–0.36 mm (or 2.04 mm).

For example, if the transparent window 61 on the mask sheet 62 is the same width as the image strip width then the image will only be displayed momentarily as the mask sheet 62 moves upwards and downwards during oscillation. Such a changeover would show pictures overlapping for 50% of the time. On the other hand, if the transparent window 61 is much narrower than the image strip width, then the light illumination will be restricted, the traverse time of the transparent window across the image strip increased and the changeover time to the next picture too short having the effect of losing the attraction of movement.

It has been found, for best results, that the transparent windows 61 on the mask sheet 62 should correspond to between 30% and 60% of the image strip width, preferably about 45% of the image strip width.

As previously described, the y-axis curvature of the platen 38 has been chosen to minimise friction between the image sheet 48 and the mask sheet 62 while maintaining constant overall contact between both. Any loss of contact may result in part of another image being shown at the point where contact has been lost. The friction therefore between the image sheet 48 and the mask sheet 62 can result in wear on either touching surface.

Such wear initially becomes evident as scratches. It is envisaged that the image sheet 48 will be changed frequently as advertising needs change, however the mask sheet 62 may remain in place for up to one year or until the next normal maintenance programme. Friction is vastly reduced by application of a dry lubricant, for example talcum powder.

In addition, applying a clear micro film laminate to either, or one of, the touching surfaces along with the dry lubricant greatly enhances the visual performance for adverts used in the longer term.

It will be appreciated that, in the illustrated embodiment, the image sheet 48 is stationary on the platen 38, whilst the mask sheet 62 is urged to oscillatingly move over the fixed image sheet 48. Equally, the mask sheet 62 might be fixed in place and the image sheet 48 arranged to oscillatingly move relative to the mask sheet 62.

It will further be appreciated that, in the illustrated embodiment, the mask sheet is located in touching contact and over the image sheet 48. Equally, this arrangement can be reversed as desired.

What is claimed is:

1. An illuminated display device comprising an illuminated image sheet, comprising a plurality of series of image portions;

a mask sheet having alternate opaque and transparent strips, the mask sheet being located in face-to-face relation to the image sheet;

first and second roller means in a substantially parallel spaced-apart arrangement relative to the image sheet and the mask sheet, the first and second roller means being operatively associated with one of the image sheet and the mask sheet; and means to oscillatingly move the one of the image sheet and the mask sheet relative to the other of the image sheet and the mask sheet, the moving means including a drive means;

a cam rotatably driven by the drive means;

a cam follower lever associated with the cam; and a crank mechanism comprising a crank lever operatively associated with the first roller means and a linkage mechanism connecting the cam follower lever and the crank lever.

2. An illuminated display device according to claim 1, in which the image sheet comprises at least three series of image portions.

3. An illuminated display device according to claim 1, in which two opposing cam followers and two opposing crank mechanisms are provided so that the drive means is arranged, in operative association with the first and second roller means, to impart oscillating movement to the first roller means and equal and opposite oscillating movement to the second roller means.

4. An illuminated display device according to claim 1, in which the length of the first and second roller means is 10%–50% of the width of the image sheet.

5. An illuminated display device according to claim 1, in which the one of the image sheet and the mask sheet which is operatively associated with the first and second roller means is tensioned by providing at least one pair of tension springs, the, or each, pair of tension springs forming a substantially V-shaped arrangement of tension lines, the apex of the substantially V-shaped arrangement being the transverse mid-line of the opposite roller means; and an opposing at least one pair of tension springs forming a substantially inverted V-shaped arrangement of tension lines, the substantially inverted V-shaped arrangement apex being the transverse mid-line of the opposite of the roller means.

6. An illuminated display device according to claim 1, in which the image sheet and the mask sheet are supported on a platen and the maximum height of curvature of the platen in the y-axis is between 0.3 and 2% of the length of the platen in the y-axis.

7. An illuminated display device according to claim 6, in which the one of the image sheet and the mask sheet which is operatively associated with the first and second roller means is tensioned by providing at least one pair of tension springs, and in which the at least one pair of tension springs are arranged below a notional extension of the y-axis curvature of the platen.

8. An illuminated display device according to claim 6, in which the platen has a maximum transverse curvature of between 3% and 20% of the maximum longitudinal curvature of the platen.

9. An illuminated display device according to claim 1, in which each image portion forming one series of image portions has a pitch of 0.025–0.25% of the y-axis length of the image sheet.

10. An illuminated display device according to claim 9, in which each transparent window of the mask sheet has a pitch of 30–60% of the pitch of each image portion.

11. An illuminated display device according to claim 1, in which the image sheet comprises at least four series of image portions.

12. An illuminated display device according to claim 1, in which the image sheet comprises five series of image portions.

13. An illuminated display device according to claim 1, in which the image sheet and the mask sheet are supported on a platen and the maximum height of curvature of the platen in the y-axis is 0.8% of the length of the platen in the y-axis.

14. An illuminated display device according to claim 1, in which each image portion forming one series of image portions has a pitch of 0.05–0.21% of the y-axis length of the image sheet.

15. An illuminated display device according to claim 1, in which each image portion forming one series of image portions has a pitch of 0.075–0.15% of the y-axis length of the image sheet.

16. An illuminated display device according to claim 9, in which each transparent window of the mask sheet has a pitch of about 45% of the pitch of each image portion.

17. An illuminated display device according to claim 14, in which each transparent window of the mask sheet has a pitch of about 45% of the pitch of each image portion.

18. An illuminated display device according to claim 15, in which each transparent window of the mask sheet has a pitch of 30–60% of the pitch of each image portion.

19. An illuminated display device according to claim 15, in which each transparent window of the mask sheet has a pitch of about 45% of the pitch of catch image portion.

20. An illuminated display device according to claim 13, in which the one of the image sheet and the mask sheet which is operatively associated with the first and second roller means is tensioned by providing at least one pair of tension springs, and in which the at least one pair of tension springs are arranged below a notional extension of the y-axis curvature of the platen.

* * * * *

UNITED STATES PATENT AND TRADEMARK OFFICE

CERTIFICATE OF CORRECTION

PATENT NO. : 6,405,463 B1
DATED : June 18, 2002
INVENTOR(S) : Roddy et al.

It is certified that error appears in the above-identified patent and that said Letters Patent is hereby corrected as shown below:

Column 4,
Line 43, “of” should read -- or --.

Column 8,
Line 54, “revolutions” should read -- revolution --

Column 12,
Line 19, “comprising” should read -- comprising: --
Line 64, “of the” should be deleted Column 13,
Line 9, “are” should read -- is --

Column 14,
Line 21, “catch” should read -- each --

Signed and Sealed this

Thirtieth Day of September, 2003

JAMES E. ROGAN
*Director of the United States Patent and Trademark Office*